US005612661A

United States Patent [19]

Twenter et al.

[11] Patent Number: 5,612,661

[45] Date of Patent: Mar. 18, 1997

[54] RESETTABLE INTERNAL ACTUATING MECHANISM FOR USE WITH AN ELECTRONIC SECTIONALIZER

[75] Inventors: Byron T. Twenter, Columbia; Daren A. Clark, Centralia, both of Mo.

[73] Assignee: Hubbell Incorporated, Conn.

[21] Appl. No.: 440,704

[22] Filed: May 15, 1995

[51] Int. Cl.[6] ..... H01H 71/10

[52] U.S. Cl. ..... 337/169; 337/171; 361/115

[58] Field of Search ..... 337/168–179; 361/115, 102

[56] References Cited

U.S. PATENT DOCUMENTS

| | | | |
|---|---|---|---|
| 1,954,849 | 4/1934 | Seese | 175/294 |
| 1,982,986 | 12/1934 | Garlington | 200/89 |
| 2,053,445 | 9/1936 | Rose | 175/294 |
| 3,418,529 | 12/1968 | Attewell | 317/11 |
| 4,553,188 | 11/1985 | Aubrey et al. | 361/115 |
| 4,768,010 | 8/1988 | Brown et al. | 337/169 |
| 4,795,996 | 1/1989 | Brown et al. | 337/169 |
| 4,797,777 | 1/1989 | Beard | 361/115 |
| 4,935,715 | 6/1990 | Popeck | 337/169 |
| 5,162,967 | 11/1992 | Torrontegui | 361/115 |
| 5,172,090 | 12/1992 | Ranjan et al. | 337/169 |

FOREIGN PATENT DOCUMENTS

| | | |
|---|---|---|
| 667078 | 2/1952 | United Kingdom . |
| 1076778 | 7/1967 | United Kingdom . |
| 1109320 | 4/1968 | United Kingdom . |

*Primary Examiner*—Leo P. Picard
*Assistant Examiner*—Jayprakash N. Gandhi
*Attorney, Agent, or Firm*—Jerry M. Presson; Michael R. Swartz

[57] ABSTRACT

A resettable internal actuating mechanism, used in an electronic sectionalizer having a tube assembly movable between a closed position and an open position, includes a latching element of an electro-mechanical component mounted in the tube assembly and biased to move to an extended position and movable to a retracted position in response to receipt of an electrical signal, an actuating member spaced from the latching element and mounted in the tube assembly and being biased to move from a non-actuated position to an actuated position, and a linking lever mounted in the tube assembly between the latching element and the actuating member and biased to pivotably move from a latched position to an unlatched position. The linking lever has opposite ends latched respectively to the latching element and actuating member when the linking lever is at the latched position and the latching element is at the extended position to thereby hold the actuating member at the non-actuated position. The opposite ends of the linking lever unlatches respectively from the latching element and from the actuating member in response to the latching element being moved to the retracted position to thereby release the linking lever to move to the unlatched position and the actuating member to move to the actuated position.

24 Claims, 3 Drawing Sheets

RESETTABLE INTERNAL ACTUATING MECHANISM FOR USE WITH AN ELECTRONIC SECTIONALIZER

BACKGROUND OF THE INVENTION

1. Field of the Invention

The present invention generally relates to electronic sectionalizers and, more particularly, is concerned with a resettable internal actuating mechanism for use with an electronic sectionalizer.

2. Description of the Prior Art

High voltage power distribution systems are typically comprised of a main supply line that is connected to a number of branch or lateral lines. Normally, the main line is protected near its source of power by an automatic recloser or a reclosing circuit breaker which is operable to disable the entire system downstream of the recloser if currents above a certain magnitude are detected. Automatic reclosers and reclosing circuit breakers are particularly useful for enabling transient fault currents to clear after which time the recloser can again energize the circuit. However, if fault current conditions remain, the recloser after one or more attempts to re-energize the circuit will cease operation and cause the distribution system to remain in a deactivated state until attended by a repairman.

In the past, fuse links were often installed at the beginning of each lateral line to protect the line and isolate it from the rest of the distribution system where over-current conditions existed only in a particular lateral line. Many problems were observed, however, in attempting to coordinate the opening characteristics of the fuse links with the reclosing apparatus and in attempting to ensure that the fuse link would not melt and open the lateral line before the reclosing apparatus had an opportunity to deactivate the entire system. As a consequence, electronic sectionalizers have been developed which instead count the number of times that the recloser opens and closes the circuit. After a specified number of current flow periods or "shots," the electronic sectionalizer disables the lateral line during a subsequent dead interval when the reclosing apparatus has opened if over-current conditions in the lateral line protected by the sectionalizer are detected. For additional disclosure of electronic sectionalizers, reference is hereby made to U.S. Pat. No. 4,553,188 to Aubrey et al. and U.S. Pat. No. 4,768,010 to Brown et al.

Various actuating mechanisms have been developed in recent years having actuators for releasing sectionalizers. The typical actuator operates in conjunction with a pivot mechanism which cooperates with a latch that is released or opened by the actuating mechanism. In other words, once fired, the actuator causes a latch or release lever to swing and then a spring and/or the forces of gravity are utilized so as to complete the pivotal movement and ensure that the tube of the sectionalizer shifts downwardly and away from the upper contact to open the lateral line. Thus, the force exerted by the actuator does not directly impart movement of the tube toward an isolating position, but merely moves a latch so that either an over-centering spring or the force of gravity is subsequently operable to urge the tube to fall away from the upper contact.

Representative examples of these actuating mechanisms are disclosed in U.S. Pat. Nos. 4,768,010 and 4,795,996 to Brown et al., U.S. Pat. No. 5,162,967 to Torrontegui and U.S. Pat. No. 5,172,090 to Ranjan et al. In a first approach, the disclosure in U.S. Pat. No. 4,768,010 to Brown includes a detonation actuator which can be used only once and requires replacement after the actuator is detonated and the sectionalizer tube is released. In a second approach, a resettable solenoid-type actuator is disclosed in U.S. Pat. No. 4,795,996 to Brown and in the patents to Torrontegui and Ranjan. The actuating mechanisms in the patents which follow this second approach are either external or internal. In the patent to Ranjan, the actuator is external. A problem exists, however, with those actuators which are external in that they are exposed to environmental conditions subjecting them to corrosion and/or ice which may prevent the successful drop-out of the sectionalizer tube. Wind and stormy weather may also cause the actuating mechanism to vibrate and thus to result in the unwanted triggering of the release of the sectionalizer tube. While the actuator disclosed in U.S. Pat. No. 4,795,996 to Brown is mostly internal, the mechanism remains susceptible to vibration from wind and stormy weather. Although the actuator disclosed in the patent to Torrontegui is entirely internal, a problem remains in that the sectionalizer assembly has many parts and is unduly complex.

Consequently, a need still exists for an actuating mechanism designed to overcome the aforementioned problems in the prior art without introducing any new problems in their place.

SUMMARY OF THE INVENTION

The present invention provides a resettable internal actuating mechanism which is designed to satisfy the aforementioned need by avoiding the drawbacks of the prior art without introducing new disadvantages. The actuating mechanism of the present invention minimizes the number of parts required and the complexity of their arrangement while increasing the reliability of their operation. The incorporation of the actuating mechanism of the present invention in an electronic sectionalizer enables it to better withstand the variety of adverse environmental conditions.

Accordingly, the present invention is directed to a resettable internal actuating mechanism for an electronic sectionalizer having a tube assembly movable between a closed position and an open position. The actuating mechanism comprises: (a) an electro-mechanical means mounted in the tube assembly and biased to move to an extended position and movable to a retracted position in response to receipt of an electrical signal; (b) actuating means spaced from the electro-mechanical means and mounted in the tube assembly and being biased to move from a non-actuated position to an actuated position; and (c) linking means mounted in the tube assembly between the electro-mechanical means and the actuating means and biased to pivotably move from a latched position to an unlatched position. The linking means has opposite ends latched respectively to the electro-mechanical means and to the actuating means when the linking means is at the latched position and the electro-mechanical means is at the extended position to thereby hold the actuating means at the non-actuated position. The opposite ends of the linking means unlatch respectively from the electro-mechanical means and from the actuating means in response to the electro-mechanical means being moved to the retracted position to thereby release the linking means to move to the unlatched position and the actuating means to move to the actuated position. Furthermore, in the process of moving from the non-actuated to the actuated position, the actuating means extends outwardly from the bottom of the tube assembly and moves a latching mechanism from a locking position to a releasing position to cause movement of the tube assembly from the closed to the open position.

More particularly, the electro-mechanical means has a latching element in the form of a plunger movable from the extended to the retracted position in response to receipt of the electrical signal and a first means in the form of a coiled spring coupled thereto for biasing the plunger to move to the extended position in absence of receipt of the electrical signal by the electro-mechanical means. The actuating means has an actuating member in the form of an elongated rod spaced from the electro-mechanical means to undergo movement from the non-actuated to the actuated position to correspondingly permit movement of the tube assembly from the closed to the open position and a second means in the form of a coiled spring coupled thereto for biasing the rod to move to the actuated position. The linking means has a linking lever in the form of an elongated arm disposed between the latching element and the actuating member to undergo pivotal movement from the latched to the unlatched position and a third means in the form of a spring coupled thereto for biasing the arm to pivotably move to the unlatched position. The bottom end of the rod of the actuating means extends out through an opening in the bottom of the tube assembly of the sectionalizer and by moving from the non-actuated to the actuated position causes pivotal movement of the latching mechanism from the locking to the releasing position to thereby cause movement of the tube assembly from the closed to the open position.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
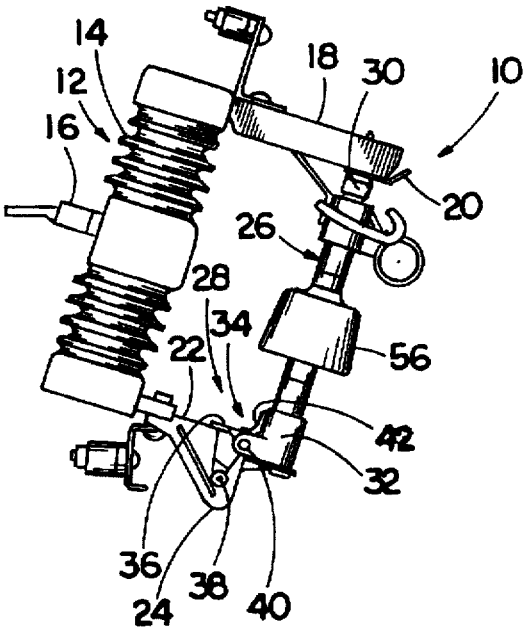
FIG. 1 is a side elevational view of an electronic sectionalizer incorporating an actuating mechanism of the present invention showing a latching mechanism in a locked position and a tube assembly of the sectionalizer in a closed position.

In the following description, like reference characters designate like or corresponding parts throughout the several views. Also in the following description, it is to be understood that such terms as "top", "bottom", "upper", "lower", "right", "left" and the like, are words of convenience and are not to be construed as limiting terms.

Electronic Sectionalizer—In General

Referring to the drawings and particularly to FIGS. 1 to 7, there is illustrated an electronic sectionalizer, being generally designated 10, incorporating the present invention which will be described later below. The sectionalizer 10 is carried by a mounting structure 12 having an insulator 14 and an arm 16 attached thereto for securing the structure 12 to a utility pole or the like. The mounting structure 12 has an upper electrical contact 18 that includes a conductive, downward biased arm 20 having a concave detent, and a lower electrical contact 22 spaced from the upper contact 18 and mounted on an opposite end region of the insulator 14. The lower contact 22 includes a pair of spaced, hook-shaped portions 24 (only one shown) on which the sectionalizer 10 is carried.

Figure 2:
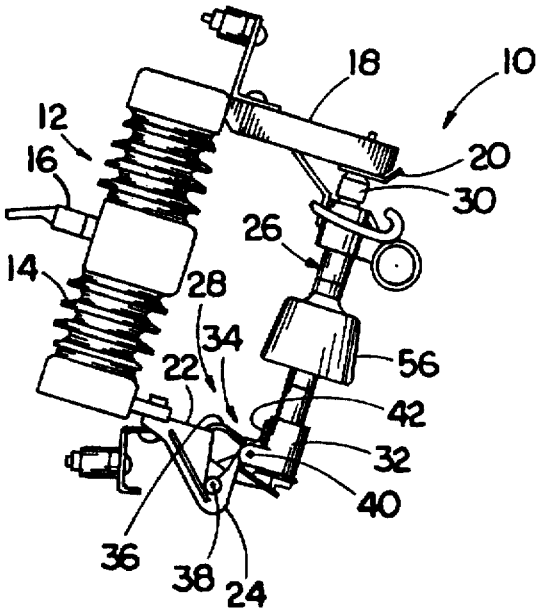
FIG. 2 is a view similar to that of FIG. 1 except showing the start of movement of an end of an actuating member of the actuating mechanism from a non-actuated position toward an actuated position but before the latching mechanism has moved from the locked position to a released position.
Figure 3:
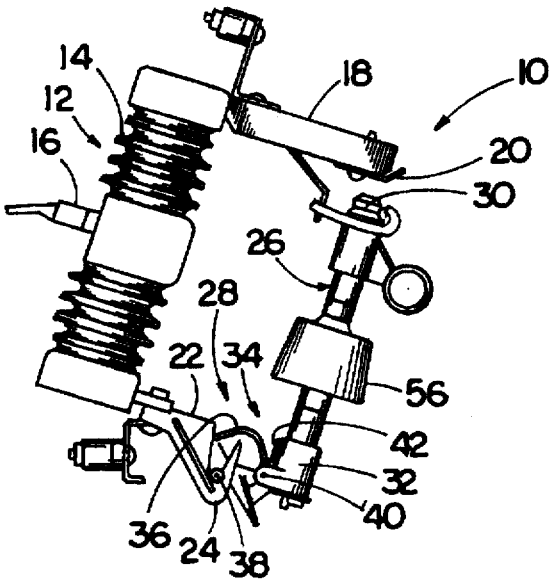
FIG. 3 is a view similar to that of FIG. 2 except showing further movement of the end of the actuating member of the actuating mechanism from the non-actuated position toward the actuated position, the latching mechanism in the released position and the tube assembly between the closed position and an open position.
Figure 4:
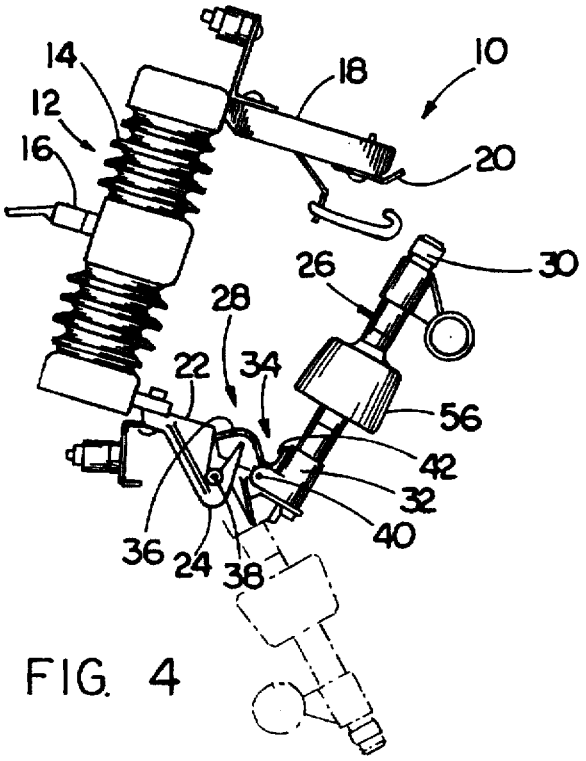
FIG. 4 is a view similar to that of FIG. 3 except showing the end of the actuating member of the actuating mechanism in the actuated position, the latching mechanism in the released position and the tube assembly in the open position.

The sectionalizer 10 basically includes a tube assembly 26 and a release means 28. The tube assembly 26 is an elongated electrically conductive, substantially, hollow structure having an upper terminus 30 and a lower terminus 32 (best seen in FIGS. 5–7). The upper terminus 30 is received in the concave detent of the arm 20 of the upper contact 18. The release means 28 is provided between the lower terminus 32 of the tube assembly 26 and the mounting structure 12 for holding the tube assembly 26 in engagement with the upper contact 18 and releasing the tube assembly 26 therefrom so as to permit the tube assembly 26 to move from a closed position of the sectionalizer 10, as shown in FIGS. 1 and 2, to an open position of the sectionalizer 10, as shown in FIGS. 3 and 4. The release means 28 preferably is in the form of a latching mechanism 34 which interconnects the tube assembly 26 and the lower contact 22 of the mounting structure 12 and is movable between a locking position, as shown in FIGS. 1 and 5 to 7, and a releasing position, as shown progressively in FIGS. 2 to 4, to cause movement of the tube assembly 26 between the closed and open positions.

Figure 7:
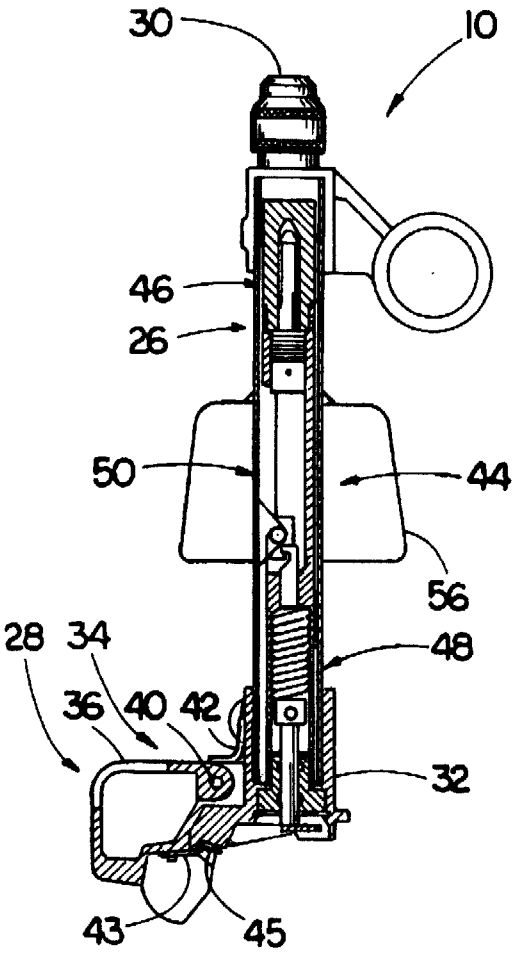
FIG. 7 is a longitudinal sectional view of the latching mechanism and the tube assembly of the electronic sectionalizer taken along line 7—7 in FIG. 6, also showing the actuating mechanism of the present invention located in the tube assembly.
Figure 6:
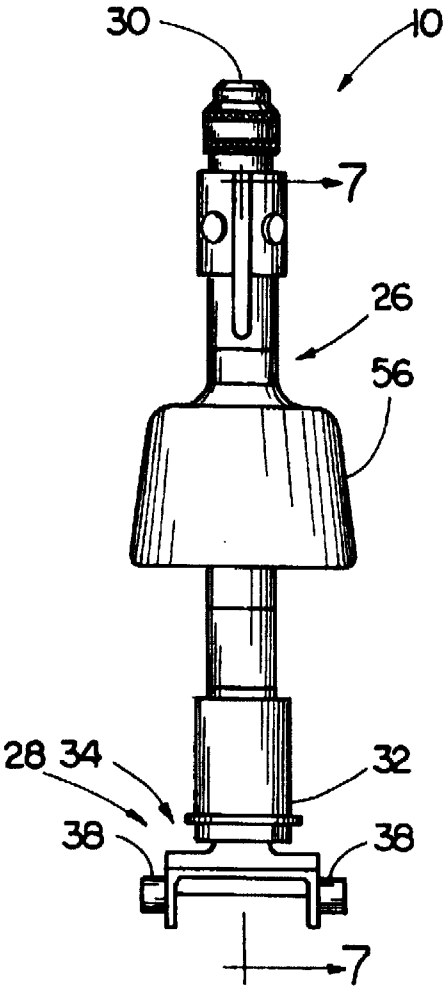
FIG. 6 is a front elevational view of the latching mechanism and the tube assembly as shown along line 6—6 in FIG. 5.
Figure 5:
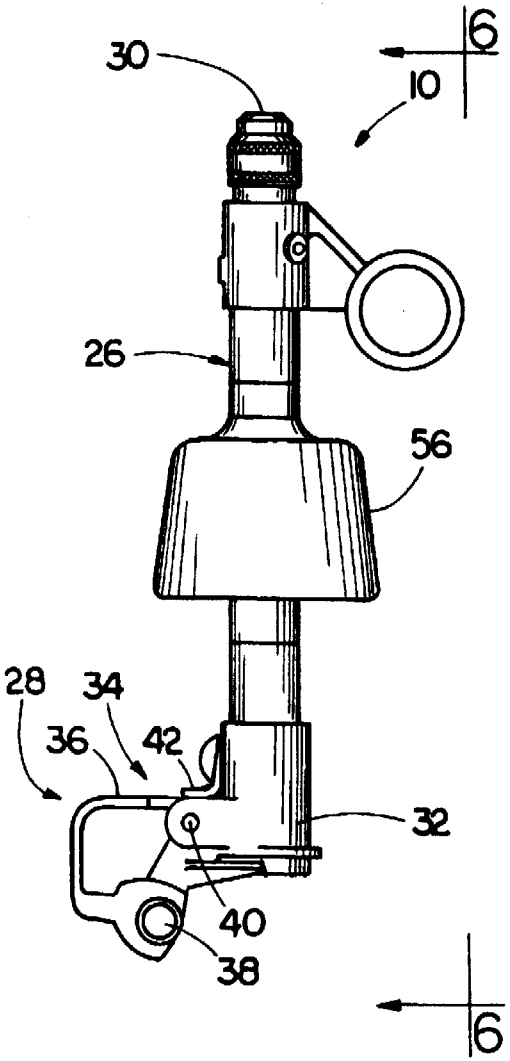
FIG. 5 is an enlarged side elevational view of the latching mechanism and the tube assembly of the electronic sectionalizer shown in FIG. 1.

The latching mechanism 34 includes a trunnion member 36 disposed substantially between the pair of hook-shaped portions 24 of the lower contact 22 and having a pair of cylindrical pins 38 that extend horizontally outwardly in opposite directions and which are received in the respective hook portions 24. The trunnion member 36 is pivotally connected by means of a third cylindrical pin 40 to the lower terminus 32 of the tube assembly 26. A pivotal axis defined by the third pin 40 extends parallel to a central axis defined by the pair of pins 38 for enabling swinging motion of the trunnion member 36 relative to the tube assembly 26 during simultaneous swinging movement of the trunnion member 36 relative to the hook portions 24. The latching mechanism 34 also includes a spring contact 42 secured to the lower terminus 32 of the tube assembly 26 which normally engages a raised portion of the trunnion member 36 when the tube assembly 26 is in its current-carrying or closed position, as shown in FIG. 1, for facilitating the flow of current from the upper contact 18 along the length of the tube assembly 26 and therefrom across the trunnion member 36 to the lower contact 22. The latching mechanism 34 further includes a spring latch 43 that normally retains the trunnion member 36 in its position shown in FIGS. 1 and 2. As best seen in FIG. 7, one end of the spring latch 43 is secured to the undersurface of the trunnion member 36 whereas the other end thereof presents a raised shoulder 45 that is releasably engageable with a conforming cavity provided on the undersurface of the lower terminus 32.

Resettable Internal Actuating Mechanism

Figure 10:
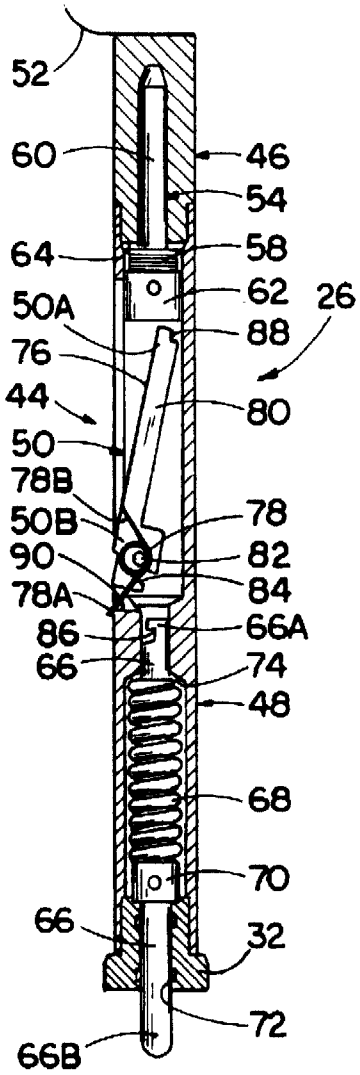
FIG. 10 is a still another longitudinal sectional view of the actuating mechanism showing its electro-mechanical means in the retracted position, actuating means in an actuating position and linking means in the unlatched position.
Figure 9:
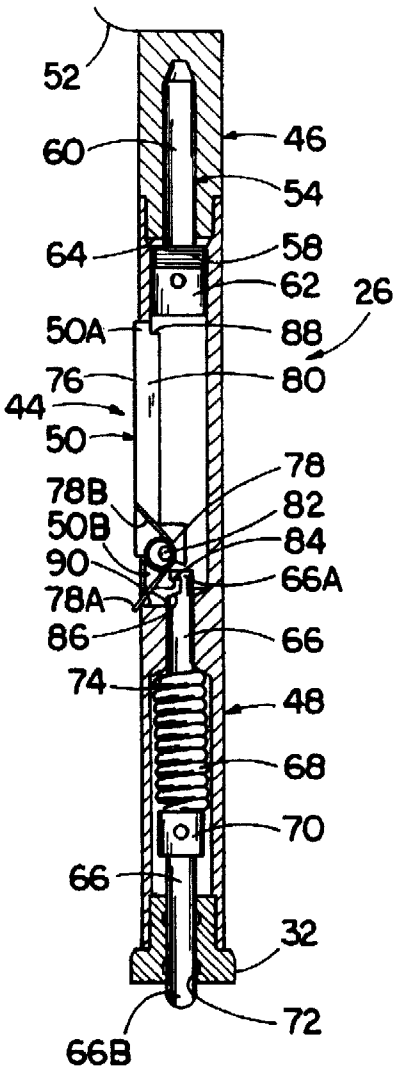
FIG. 9 is another longitudinal sectional view of the actuating mechanism showing its electro-mechanical means in a retracted position, actuating means in the non-actuating position and linking means in an unlatched position.
Figure 8:
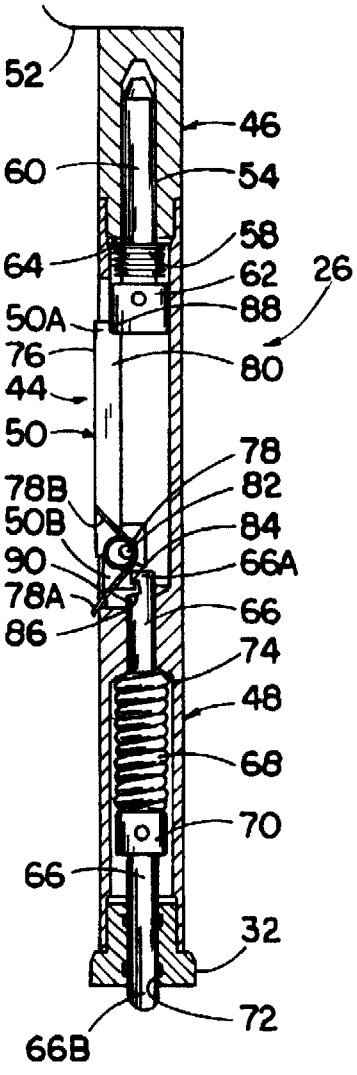
FIG. 8 is an enlarged longitudinal sectional view of the actuating mechanism showing its electro-mechanical means in an extended position, actuating means in a non-actuating position and linking means in a latched position.

Referring to FIGS. 7 to 10, there is illustrated a resettable internal actuating mechanism 44 of the present invention incorporated in the tube assembly 26 of the electronic sectionalizer 10 for improving the releasing and resetting of the tube assembly 26 of the sectionalizer 10 from and back to the closed position. The actuating mechanism 44 basically includes an electro-mechanical means 46, an actuating means 48 and a linking means 50. The electro-mechanical means 46 is mounted in the tube assembly 26 and biased to move to an extended position, as shown in FIGS. 7 and 8, and is movable against the bias to a retracted position, as shown in FIGS. 9 and 10, in response to receipt of an electrical signal on a conductor wire 52. The actuating means 48 is spaced longitudinally in the tube assembly 26 from the electro-mechanical means 46 and biased to move from the non-actuated position, as shown in FIGS. 7 to 9, to the actuated position, as shown in FIG. 10, to thereby cause the latching mechanism 34 to move from the locking position, as seen in FIGS. 1 and 2, to the releasing position, as seen in FIGS. 3 and 4, and correspondingly cause movement of the tube assembly 26 from the closed position, as seen in FIGS. 1 and 2, to the open position, as seen in FIGS. 3 and 4. The linking means 50 is mounted in the tube assembly 26 between the electro-mechanical means 46 and the actuating means 48 and biased to pivotably move from a latched position, as shown in FIGS. 7 and 8, to an unlatched position, as shown in FIGS. 9 and 10. The linking means 50 further has opposite upper and lower ends 50A and 50B latched respectively to the electro-mechanical means 46 and to the actuating means 48 when the linking means 50 is at the latched position and the electro-mechanical means 46 is at the extended position to thereby hold the actuating means 48 at the non-actuated position wherein the opposite ends 50A and 50B unlatch respectively from the electro-mechanical means 46 and from the actuating means 48 in response to the electro-mechanical means 46 being moved to the retracted position to thereby release the linking means 50 to move to the unlatched position and the actuating means 48 to move to the actuated position.

The electro-mechanical means 46 of the actuating mechanism 44 is preferably an electromagnetic solenoid having a latching element 54 preferably in the form of an armature or plunger 54 made of ferromagnetic material and mounted in the tube assembly 26 so as to undergo movement in a substantially longitudinal direction from the extended position to the retracted position in response to receipt of the electrical signal by the electro-mechanical means 46. The solenoid also has an electrical coil (not shown) located within the tube assembly 26 and surrounding the plunger 54. The coil of the solenoid is energized by the electrical signal received on conductor wire 52 so as to produce an electromotive force causing movement of the plunger 54 to the retracted position. The electrical signal is generated by a logic circuit contained in a housing 56 on the tube assembly 26 as seen in FIGS. 1–7. Once the logic circuit has determined that an over-current condition exists in the lateral or branch line protected by the sectionalizer 10, the logic circuit energizes the coil of the solenoid and causes retractive movement of the plunger 54.

Still referring to FIGS. 8–10, the electro-mechanical means 46 also includes a biasing means in the form of a coiled spring 58 which engages and biases the plunger 54 to move to the extended position in absence of receipt of the electrical signal by the electro-mechanical means 46. The plunger 54 has an upper stem portion 60 and a lower enlarged head portion 62 attached to a lower end of the stem portion 60. The coiled spring 58 is disposed about a lower end of the stem portion 60 between the enlarged head portion 62 and a shoulder 64 formed in the tube assembly 26. The compressive state of the coiled spring 58 is such that it engages and yieldably biases the plunger 54 to move to the extended position for retaining the linking means 50 in said latched position. As seen in FIGS. 7 and 8, the enlarged head portion 62 of the plunger 54 is in blocking engagement with the upper end 50A of the linking means 50 when the plunger 54 is at the extended position so as to retain the linking means 50 in the latched position. As seen in FIGS. 9 and 10, retraction of the plunger 54 moves the enlarged head portion 62 out of blocking engagement with the upper end 50A of the linking means 50 and so allows the linking means 50 to move to the unlatched position.

The actuating means 48 of the actuating mechanism 44 includes an actuating member 66 preferably in the form of an elongated rod 66 spaced longitudinally in the tube assembly 26 from the plunger 54 of the electro-mechanical means 46 and mounted in the tube assembly 26 to undergo movement in a substantially longitudinal direction between the non-actuated position of FIGS. 8 and 9 and the actuated position of FIG. 10 to correspondingly permit movement of the tube assembly 26 between the closed positions of FIGS. 1 and 2 and open position of FIGS. 3 and 4. The longitudinal direction of movement of the elongated rod 66 is generally parallel to the longitudinal direction of movement of the plunger 54.

The actuating means 48 also includes a coiled spring 68 coupled to the elongated rod 66 so as to bias it to move to the actuated position. The elongated rod 66 has a pair of opposite top and bottom ends 66A, 66B and an enlarged collar 70 mounted on the elongated rod 66 between and spaced from the opposite top and bottom ends 66A, 66B thereof. The top end 66A of the elongated rod 66 is engaged with the lower end 50B of the linking means 50 when the linking means 50 is at the latched position, as seen in FIGS. 8 and 9, so as to retain the elongated rod 66 in the non-actuated position. The bottom end 66B of the elongated rod 66 extends outwardly through an opening 72 in the lower terminus 32 of the tube assembly 26 and is movable farther outwardly from the lower terminus 32 of the tube assembly 26 upon movement of the elongated rod 66 from its non-actuated position to actuated position, as can been seen by comparing FIGS. 8 and 9 with FIG. 10. The coiled spring 68 of the actuating means 48 is mounted between the enlarged collar 70 on the elongated rod 66 and a first annular ledge 74 formed in the tube assembly 26. The compressive state of the coiled spring 68 is such as to yieldably bias the elongated rod 66 to move to the actuated position.

The linking means 50 of the actuating mechanism 44 includes a linking lever 76 and a biasing spring 78. The linking lever 76 is disposed between the plunger 54 of the electro-mechanical means 46 and the elongated rod 66 of the actuating means 48 and mounted in the tube assembly 26 to undergo pivotal movement between the latched position of FIGS. 8 and 9, and the unlatched position of FIG. 10. The biasing spring 78 is coupled to the linking lever 76 so as to bias the linking lever 76 to pivotably move to the unlatched position.

The linking lever 76 preferably is in the form of an elongated arm 80 defining the opposite upper and lower ends 50A, 50B of the linking means 50, and a pivot pin 82 extending through the arm 80 at a point relatively closer to the lower end 50B of the arm 80 than to the upper end 50A thereof. The lower end 50B of the arm 80 has a first notch 84 formed therein for interfitting with a second notch 86 formed in the top end 66A of the rod 66. The upper end 50A of the arm 80 has a third notch 88 formed therein for interfitting with a corner of the lower enlarged head portion 62 of the plunger 54 when the linking means 50 is in the latched position. The biasing spring 78 is mounted about the pivot pin 82 and captured at one end 78A by a ledge 90 formed in the tube assembly 26 and at the opposite end 78B by a portion of the arm 80. The spring 78 is maintained in such state of compression to yieldably bias the arm 80 to move from the latched position of FIGS. 8 and 9 to the unlatched position of FIG. 10 when the head portion 62 is removed from the third notch 88 in the upper end 50A of the arm 80.

Referring to FIGS. 1 to 4 and 7 to 10, actuation of the sectionalizer 10 occurs when the actuating member 66, which at its bottom end 66B protrudes slightly outwardly from the opening 72 in the lower terminus 32 of the tube assembly 26, moves farther outwardly from the non-actuated position (FIGS. 8 and 9) to the actuated position (FIG. 10) to thereby cause pivotal movement of the latching mechanism 34 from the locking position (FIGS. 1 and 2) to the releasing position (FIGS. 3 and 4) to thereby cause movement of the tube assembly 26 from the closed position (also FIGS. 1 and 2) to the open position (also FIGS. 3 and 4), thereby opening the circuit and preventing the flow of current through the sectionalizer 10. This actuation process begins when the electro-mechanical means 46 receives the electrical signal and moves from the extended position (FIG. 8) to the retracted position (FIG. 9), thereby freeing the linking means 50 to move from the latched position (FIGS. 8 and 9) to the unlatched position (FIG. 10) and the actuating means 48 to move from the non-actuated position (FIGS. 8 and 9) to the actuated position (FIG. 10). The process works repeatably and reliably by virtue of the fact that the various components of the actuating mechanism 44 are few in number and are mounted within the tube assembly 26 in a reliable and stable manner with respect to one another and shielded from adverse environmental elements, with the electro-mechanical means 46 and the actuating means 48 both movable in directions generally parallel to one another and the linking means 50 pivotal about an axis which is transverse to the directions of movement of the electro-mechanical means 46 and the actuating means 48.

The actuating member 66, once "fired" by this process, immediately swings the trunnion member 36 about the third pin 40 and simultaneously causes the trunnion member 36 to swing relative to the hook portions 24 of the lower contact 22, as shown particularly in FIGS. 1 to 4, thereby resulting in the tube assembly 26 shifting downwardly and away from the upper contact 18 toward the open position. All of the force exerted by the actuating mechanism 44 is directed toward the trunnion member 36, causing the latter to move away from the tube assembly 26. The pivotal movement of the trunnion member 36 downward and away from the tube assembly 26 causes instantaneous downward movement of the tube assembly 26 away from the upper contact 18 with a force (assisted by gravity) that is sufficient to cause drop-out of the tube assembly 26 even in adverse environmental conditions. A repairman can easily reset the sectionalizer 10 by gripping the edges of trunnion member 36 and rotating it back from the open position of FIG. 4 to its closed position of FIG. 1.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. In an electronic sectionalizer having a tube assembly movable between a closed position and an open position, an actuating mechanism comprising:

(a) an electro-mechanical means mounted in said tube assembly and biased to move to an extended position and movable to a retracted position in response to receipt of an electrical signal;

(b) actuating means spaced from said electro-mechanical means and mounted in said tube assembly and being biased to move from a non-actuated position to an actuated position; and (c) linking means mounted in said tube assembly between said electro-mechanical means and said actuating means and biased to pivotably move from a latched position to an unlatched position;

(d) said linking means having opposite upper and lower ends being latched respectively to said electro-mechanical means and to said actuating means when said linking means is at said latched position and said electro-mechanical means is at said extended position to thereby hold said actuating means at said non-actuated position, said opposite ends of said linking means unlatching respectively from said electro-mechanical means and from said actuating means in response to said electro-mechanical means being moved to said retracted position to thereby release said linking means to move to said unlatched position and said actuating means to move to said actuated position.

2. The mechanism as recited in claim 1, wherein said electro-mechanical means includes:

a latching element mounted in said tube assembly to undergo movement in a substantially longitudinal direction from said extended position to said retracted position in response to receipt of said electrical signal by said electro-mechanical means; and a first means coupled to said latching element for biasing said latching element to move to said extended position in absence of receipt of said electrical signal by said electro-mechanical means.

3. The mechanism as recited in claim 2, wherein said latching element is a plunger having an upper stem portion and a lower head portion attached to a lower end of said stem portion and engaged with said upper end of said linking means when said plunger is at said extended position for retaining said linking means in said latched position.

4. The mechanism as recited in claim 3, wherein said first means is a coiled spring disposed about a lower end of said stem portion between said head portion and a shoulder formed in said tube assembly, said spring yieldably biasing said plunger to move to said extended position for retaining said linking means in said latched position.

5. The mechanism as recited in claim 2, wherein said actuating means includes:

an actuating member spaced from said electro-mechanical means and mounted in said tube assembly to undergo movement in a substantially longitudinal direction between said non-actuated position and said actuated position to correspondingly permit movement of said tube assembly between the closed and open positions; and a second means coupled to said actuating member for biasing said actuating member to move to said actuated position.

6. The mechanism as recited in claim 5, wherein said actuating member is an elongated rod having a pair of opposite top and bottom ends and an enlarged collar mounted on said elongated rod between and spaced from said opposite top and bottom ends thereof, said top end of said elongated rod being engaged with said lower end of said linking means when said linking means is at said latched position for retaining said elongated rod in said non-actuated position, said bottom end of said elongated rod extending outwardly through an opening in a bottom end of said tube assembly and being movable farther outwardly from said bottom end of said tube assembly upon movement of said elongated rod from said non-actuated position to said actuated position.

7. The mechanism as recited in claim 6, wherein said second means coupled to said elongated rod is a coiled spring mounted between said enlarged collar and a ledge formed in said tube assembly, said spring yieldably biasing said elongated rod to move to said actuated position.

8. The mechanism as recited in claim 5, wherein said linking means includes:

a linking lever mounted in said tube assembly between said latching element of said electro-mechanical means and said actuating member of said actuating means to undergo pivotal movement between said latched position and said unlatched position; and a third means coupled to said linking lever for biasing said linking lever to pivotably move to said unlatched position.

9. The mechanism as recited in claim 8, wherein said linking lever includes:

an elongated arm defining said opposite upper and lower ends of said linking means; and a pivot pin mounted in said tube assembly and extending through said arm at a point relatively closer to said lower end of said arm than to said upper end of said arm, said lower end of said arm having a first notch formed therein for interfitting with a second notch in a top end of said actuating member, said upper end of said arm having a third notch formed therein for interfitting with said linking element of said electro-mechanical means when said electro-mechanical means is in said latched position.

10. The mechanism as recited in claim 9, wherein said third means coupled to said linking lever is a spring mounted about said pivot pin and captured at one end by a second ledge formed in said tube assembly and at the opposite end by a portion of said arm, said spring yieldably biasing said linking lever to move to said unlatched position.

11. The mechanism as recited in claim 8, wherein said latching element of said electro-mechanical means and said actuating member of said actuating means are movable in directions generally parallel to one another.

12. The mechanism as recited in claim 11, wherein said linking lever of said linking means is pivotal about an axis which extends transverse to the directions of movement of said latching element of said electro-mechanical means and said actuating member of said actuating means.

13. In an electronic sectionalizer having a tube assembly movable between a closed position and an open position and a latching mechanism movable between a locking position and a releasing position to cause movement of said tube assembly between said closed position and open position, an actuating mechanism comprising:

(a) an electro-mechanical means mounted in said tube assembly and biased to move to an extended position and movable to a retracted position in response to receipt of an electrical signal;

(b) actuating means spaced from said electro-mechanical means and mounted in said tube assembly and being biased to move from a non-actuated position to an actuated position to cause said latching mechanism to move from said locking to releasing position and thereby cause movement of said tube assembly from said closed to open position; and (c) linking means mounted in said tube assembly between said electro-mechanical means and said actuating means and biased to pivotably move from a latched position to an unlatched position;

(d) said linking means having opposite upper and lower ends being latched respectively to said electro-mechanical means and to said actuating means when said linking means is at said latched position and said electro-mechanical means is at said extended position to thereby hold said actuating means at said non-actuated position, said opposite ends of said linking means unlatching respectively from said electro-mechanical means and from said actuating means in response to said electro-mechanical means being moved to said retracted position to thereby release said linking means to move to said unlatched position and said actuating means to move to said actuated position to cause said latching mechanism to move to said locking to releasing position and thereby cause movement of said tube assembly from said closed to open position.

14. The mechanism as recited in claim 13, wherein said electro-mechanical means includes:

a latching element mounted in said tube assembly to undergo movement in a substantially longitudinal direction from said extended position to said retracted position in response to receipt of said electrical signal by said electro-mechanical means; and a first means coupled to said latching element for biasing said latching element to move to said extended position in absence of receipt of said electrical signal by said electro-mechanical means.

15. The mechanism as recited in claim 14, wherein said latching element is a plunger having an upper stem portion and a lower head portion attached to a lower end of said stem portion and engaged with said upper end of said linking means when said plunger is at said extended position for retaining said linking means in said latched position.

16. The mechanism as recited in claim 15, wherein said first means is a coiled spring disposed about a lower end of said stem portion between said head portion and a shoulder formed in said tube assembly, said spring yieldably biasing said plunger to move said extended position for retaining said linking means in said latched position.

17. The mechanism as recited in claim 14, wherein said actuating means includes:

an actuating member spaced from said electro-mechanical means and mounted in said tube assembly to undergo movement in a substantially longitudinal direction between said non-actuated position and said actuated position to correspondingly cause said latching mechanism to move from said locking to releasing position and thereby cause movement of said tube assembly from said closed to open position; and a second means coupled to said actuating member for biasing said actuating member to move to said actuated position.

18. The mechanism as recited in claim 17, wherein said actuating member is an elongated rod having a pair of opposite top and bottom ends and an enlarged collar mounted on said elongated rod between and spaced from said opposite top and bottom ends thereof, said top end of said elongated rod being engaged with said lower end of said linking means when said linking means is at said latched position for retaining said elongated rod in said non-actuated position, said bottom end of said elongated rod extending outwardly through an opening in a bottom end of said tube assembly and being movable farther outwardly from said bottom end of said tube assembly upon movement of said elongated rod from said non-actuated position to said actuated position to engage and cause said latching mechanism to move from said locking to releasing position and thereby cause movement of said tube assembly from said closed to open position.

19. The mechanism as recited in claim 18, wherein said second means coupled to said elongated rod is a coiled spring mounted between said enlarged collar and a ledge formed in said tube assembly, said spring yieldably biasing said elongated rod to move to said actuated position.

20. The mechanism as recited in claim 17, wherein said linking means includes:

a linking lever mounted in said tube assembly between said latching element of said electro-mechanical means and said actuating member of said actuating means to undergo pivotal movement between said latched position and said unlatched position; and a third means coupled to said linking lever for biasing said linking lever to pivotably move to said unlatched position.

21. The mechanism as recited in claim 20, wherein said linking lever includes:

an elongated arm defining said opposite upper and lower ends of said linking means; and a pivot pin extending through said arm and mounted in said tube assembly at a point relatively closer to said lower end of said arm than to said upper end thereof, said lower end of said arm having a first notch formed therein for interfitting with a second notch in a top end of said actuating member, said top end of said arm having a third notch formed therein for interfitting with said linking element of said electro-mechanical means when said electro-mechanical means is in said latched position.

22. The mechanism as recited in claim 21, wherein said third means coupled to said linking lever is a spring mounted about said pivot pin and captured at one end by a second ledge formed in said tube assembly and at the opposite end by a portion of said arm, said spring yieldably biasing said linking lever to move to said unlatched position.

23. The mechanism as recited in claim 20, wherein said latching element of said electro-mechanical means and said actuating member of said actuating means are movable in directions generally parallel to one another.

24. The mechanism as recited in claim 23, wherein said linking lever of said linking means is pivotal about an axis which extends transverse to the directions of movement of said latching element of said electro-mechanical means and said actuating member of said actuating means.

* * * * *